US005255758A

United States Patent [19]

Hood, Jr.

[11] Patent Number: 5,255,758

[45] Date of Patent: Oct. 26, 1993

[54] PROTECTIVE LADDER ASSEMBLY FOR SCAFFOLDING STRUCTURE

[75] Inventor: Roy Hood, Jr., Holden, La.

[73] Assignee: Cherokee Construction Co., Baton Rouge, La.

[21] Appl. No.: 660,568

[22] Filed: Feb. 25, 1991

[51] Int. Cl.[5] ..... E04G 5/00

[52] U.S. Cl. ..... 182/179; 182/106; 182/107

[58] Field of Search ..... 182/179, 178, 106, 116, 182/77, 82, 129, 112, 113, 107; 52/DIG. 12

[56] References Cited

U.S. PATENT DOCUMENTS

| | | | |
|---|---|---|---|
| 502,070 | 7/1893 | Fairchild | 182/106 X |
| 2,539,664 | 1/1951 | Hay | 182/106 X |
| 3,493,078 | 2/1970 | Allegri et al. | 182/113 |
| 3,992,118 | 11/1976 | Siegers | 182/179 X |
| 4,401,186 | 8/1983 | Dobersch | 182/113 |
| 4,587,786 | 5/1986 | Woods | 182/179 X |
| 4,664,225 | 5/1987 | Coutier | 182/106 X |
| 4,881,619 | 11/1989 | Coutier | 182/116 X |

FOREIGN PATENT DOCUMENTS

| | | | |
|---|---|---|---|
| 2306854 | 2/1973 | Fed. Rep. of Germany | 182/106 |
| 2645952 | 10/1976 | Fed. Rep. of Germany | 182/106 |
| 3715541 | 11/1987 | Fed. Rep. of Germany | 182/106 |

*Primary Examiner*—Alvin C. Chin-Shue

[57] ABSTRACT

A protective assembly for a ladder system is provided for scaffolding structures of the type which utilizes a connector/retention system for detachably securing upright and horizontal members. The protective assembly is comprised of substantially U-shaped and substantially J-shaped horizontal members the ends of which have secured thereto connector means and which when secured to upright members to both sides of said ladder system provides an efficient enclosed circular cage with unobstructed access from a lower ladder to a platform at the base of an upper ladder.

11 Claims, 4 Drawing Sheets

PROTECTIVE LADDER ASSEMBLY FOR SCAFFOLDING STRUCTURE

FIELD OF THE INVENTION

The present invention relates to a protective assembly for providing protection from falls from a ladder secured to a scaffolding structure.

BACKGROUND OF THE INVENTION

The type of scaffolding to which the present invention is directed is of the type used in construction and other related industries. Such scaffolding is often referred to as post and runner type which has the versatile capacity of being assembled in irregular shapes, (such as encountered in petrochemical construction and in shipbuilding), as well as in the more convention rectangular grid pattern. While early scaffolding was assembled by use of threaded clamps; most modern scaffolding is assembled by use of connection/retention systems for detachably securing together the various scaffolding members at the job site.

As industrial safety regulations become more and more stringent, scaffolding manufacturers, as well as users, seek ways of increasing the safety of operatives using the scaffolding. Much has been done to produce scaffolding which can be quickly assembled by unskilled labor to produce elaborate scaffolding structures which are rigid and relatively safe from collapse. While the basic scaffolding structure may be relatively safe from collapse or failure, ladder safety is still a concern and has heretofore not been sufficiently addressed. Because many construction scaffolding structures extend substantial distances off the ground, it is paramount that a safe ladder system be provided so an operative is protected from falling to the ground. Of course, some scaffolding structures are built with elaborate stair and railing systems. This is expensive and often not practical for many job sites.

The most common approach which is taken for providing protection to operatives using ladder secured to scaffolding structures is to build a rectangular cage around the ladder as illustrates in FIG. 1 hereof, from conventional straight vertical and horizontal scaffolding members. That is, an open-grid box-like cage is built around the ladder from the ground up to the top of the ladder system. Such a protective structure will, of course, serve the purpose of protecting an operative in case of slips and falls. The problem with such a structure is that it is expensive in that at each connection/retention level, three horizontal members must be separately attached to four upright members. Thus, at least six separate connecting operations must be employed, and a substantial amount of scaffolding material must be used.

Thus, there is a need in the art for scaffolding assemblies which can provide an operative on a ladder with adequate protection, but at a reasonable cost.

SUMMARY OF THE INVENTION

In accordance with the present invention, there is provided a scaffolding structure which uses a connector/retention system for detachably securing horizontal members to upright members, which structure is comprised of:

(a) a plurality of upright members containing retention means at vertically spaced locations for receiving connector means secured to the ends of horizontal members;

(b) a plurality of horizontal members, each containing two ends, with each end having a connector means secured thereto which are detachably connected to retention means of said upright members, thereby forming a basic scaffolding structure;

(c) a ladder which is secured to the basic scaffolding structure in a vertical position being substantially parallel to said upright members, such that there is an upright member in the proximity of each side of said ladder;

(d) curved horizontal members which are substantially U-shaped, wherein each end has secured thereto a connector means which is detachably connected to retention means of said upright members starting at a predetermined distance from the bottom of the ladder to provide unobstructed access to said ladder, which upright members are in the proximity of each side of said ladder, thereby enclosing the ladder at the level of each connection, wherein the dimensions of said curved horizontal members are such that all portions of said curved horizontal members are in the proximity of an operative on said ladder.

In another embodiment of the present invention, there is provided:

(a) two or more ladders are secured to the basic scaffolding structure between two upright members of the scaffolding structure, said ladders being in alternating vertical staggered series such that the upper section of a lower ladder covers the same vertical distance as the lower section of the next higher ladder, and such that there is an outside side of each ladder and an inside side, the outside side being in the proximity of an upright member which is part of the basic scaffolding structure and the inside side being in the proximity of a non-weight bearing upright member which is secured to the scaffolding structure between two ladders, (b) curved horizontal members which are substantially U-shaped, wherein each end has secured thereto a connector means which is detachably connected to retaining means of said upright members starting at a predetermined distance from the bottom of each ladder thereby providing on operative with unobstructed access to said ladder, and ending at the level of a platform at the base of the next higher ladder, which upright members are in the proximity of each side of said ladder, thereby enclosing the ladder at each level of connection, wherein the dimensions of said curved horizontal members are such that all portions of said curved horizontal members are in the proximity of an operative on said ladder; and (c) curved horizontal members which are substantially J-shaped starting at the level of the platform of the next higher ladder and continuing to the top of the ladder, wherein each end has secured thereto a connector means which is detachably connected at its long end to the upright member to the outside side of a ladder and the other end connected to a non-weight-bearing member to the inside side of a ladder, thereby providing unobstructed access from a lower ladder to the platform of the next higher ladder.

In one preferred embodiment of the present invention, the connector means are comprised of oppositely directed tongues projecting laterally from the horizontal members and the retention means are comprised of two cup-like retaining elements adapted to receive said tongues, one retaining element being fixed to the upright member and the other retaining element being movable in a downward direction along the upright member with respect to said fixed element.

In another preferred embodiment of the present invention, the upright member to one side of the ladder is a weight-bearing upright which is an integral part of the basic scaffolding structure and the upright member to the other side of the ladder is non-weight bearing and is secured to the outside of the basic scaffolding structure.

In yet another preferred embodiment of the present invention, the connector/retention system is comprised of a wedge which is pivotally attached to the end of the horizontal members, which end is horizontally slotted to receive a portion of a disc which is affixed to the upright members.

DETAILED DESCRIPTION OF THE INVENTION

Figure 1:
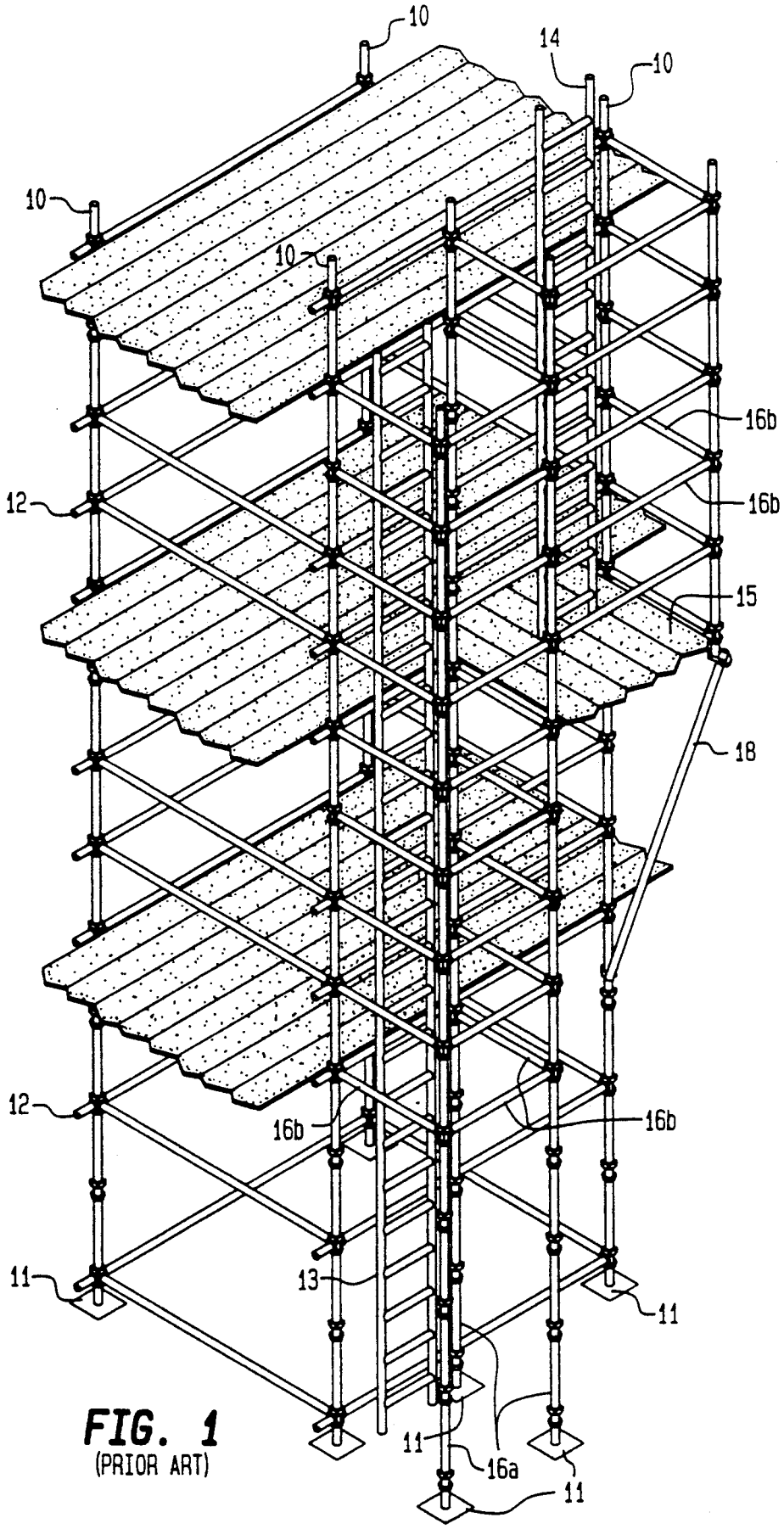
FIG. 1 (PRIOR ART)
FIG. 1 is a perspective view showing a scaffolding structure having a ladder which is provided with a protective rectangular cage assembly of the prior art.

The ladder protection assembly of the present invention can be used on any type of scaffolding system, particularly post and runner type scaffolding systems. Such systems are generally comprised of a grid of detachably secured vertical and horizontal steel tubulars with additional elements when needed, such as diagonal cross-braces, trusses, ladders, platforms, and adjustable leg bases and swivels. These systems typically employ some type of connector/retention system by which the scaffolding can be easily assembled and disassembled by unskilled labor at the job site. A retention means is typically secured, usually by welding, to the vertical members at spaced intervals. A connector means is secured to, or formed on, the ends of the horizontal members which connector means is such that it will fully cooperate with the retaining means of the upright members so both types of members can be detachably secured to one another. The protective assembly of the present invention can be modified to adapt to any connector/retention scaffolding system by attaching the appropriate connector means to the ends of the curved horizontal members of the present invention.

Non-limiting examples of connector/retention systems which may be employed in the practice of the present invention include the so-called wedge type; the double-ring support type; the peg or spigot/socket type; the lever/dish type; and the locking cup types. The wedge-type connector/retention systems generally include any of those which employ a wedge at the ends of a horizontal member to secure the horizontal members to upright members which contain cooperative retention means, such as a socket or disc which contain radially disposed cutouts for receiving the wedge. There are various types of wedge designs, such as the wedge/-cutout, or disc, design disclosed in U.S. Pat. Nos. 4,493,578; 4,587,786; 4,180,342; and 4,394,095, all of which are incorporated herein by reference. A typical wedge/disc design, such as that disclosed in U.S. Pat. No. 4,587,786, is comprised of discs vertically spaced along the length of the upright members. The discs contain a plurality of radially extending locking cutouts, or apertures, for receiving the wedge, which is typically pivotally attached to the ends of the horizontal members. The ends of the horizontal members are typically horizontally slotted to receive a portion of the disc.

Typical wedge/socket type connector/retention systems are disclosed in U.S. Pat. Nos. 4,619,541; 4,522,527; and 4,083,640which are also incorporated herein by reference. The wedge/socket system is similar to the wedge/disc system except that socket members are used as retention means along the upright members instead of discs.

A preferred type of connector/retention system which may be used on the curved horizontal members of the assembly of the present invention is the locking cup system which is manufactured by SGB Group Limited, of Surrey, England and which is disclosed in U.S. Pat. No. 3,992,118, also incorporated herein by reference. Such a system is comprised of a connector on the ends of the horizontal members such that there is provided oppositely directed tongues projecting laterally therefrom. The upright members have opposed retaining elements vertically spaced thereon and adapted to receive said tongues. One retaining element is fixed to the upright member and the other retaining element is movable, in a downward direction, along the upright member with respect to said fixed element. The arrangement is such that after separation of the retaining elements, the downward projecting tongue on each horizontal member can be engaged in the fixed retaining element and the oppositely directed projecting tongues engaged in, and by, the movable retaining element. The upright members will also contain thereon, a means for engaging the movable retaining element to clamp it against movement away from the fixed retaining element after the said projecting tongues have been engaged in and by the movable retaining element.

Turning now to FIG. 1, there is provided a perspective view of a scaffolding structure comprised of a plurality of upright tubular members 10 and a plurality of horizontal tubular members 12, all of which are not numbered in the figure. Adjustable leg bases 11 are provided for all upright members. A ladder system is comprised of a lower ladder 13, an upper ladder 14, and a platform 15 extending from the structure at the base of ladder 14. The ladder system is shown with a conventional type of protective cage assembly around it. Such a conventional protective cage assembly is excessively elaborate and expensive, from both a material and construction point of view. Such elaborate protection systems are not necessary to provide protection for operatives using a ladder. The ladder protection assembly of the present invention provides more than adequate protection for operatives, yet it utilizes less material and is easier to assemble, than such conventional assemblies. For example, conventional assemblies require, in addition to the basic scaffolding structure, at least 3 non-weight bearing upright members 16a and the necessary straight horizontal members 16b at each level of connection to complete the cage assembly. There is also provided a diagonal brace 18 for supporting platform 15.

Figure 2:
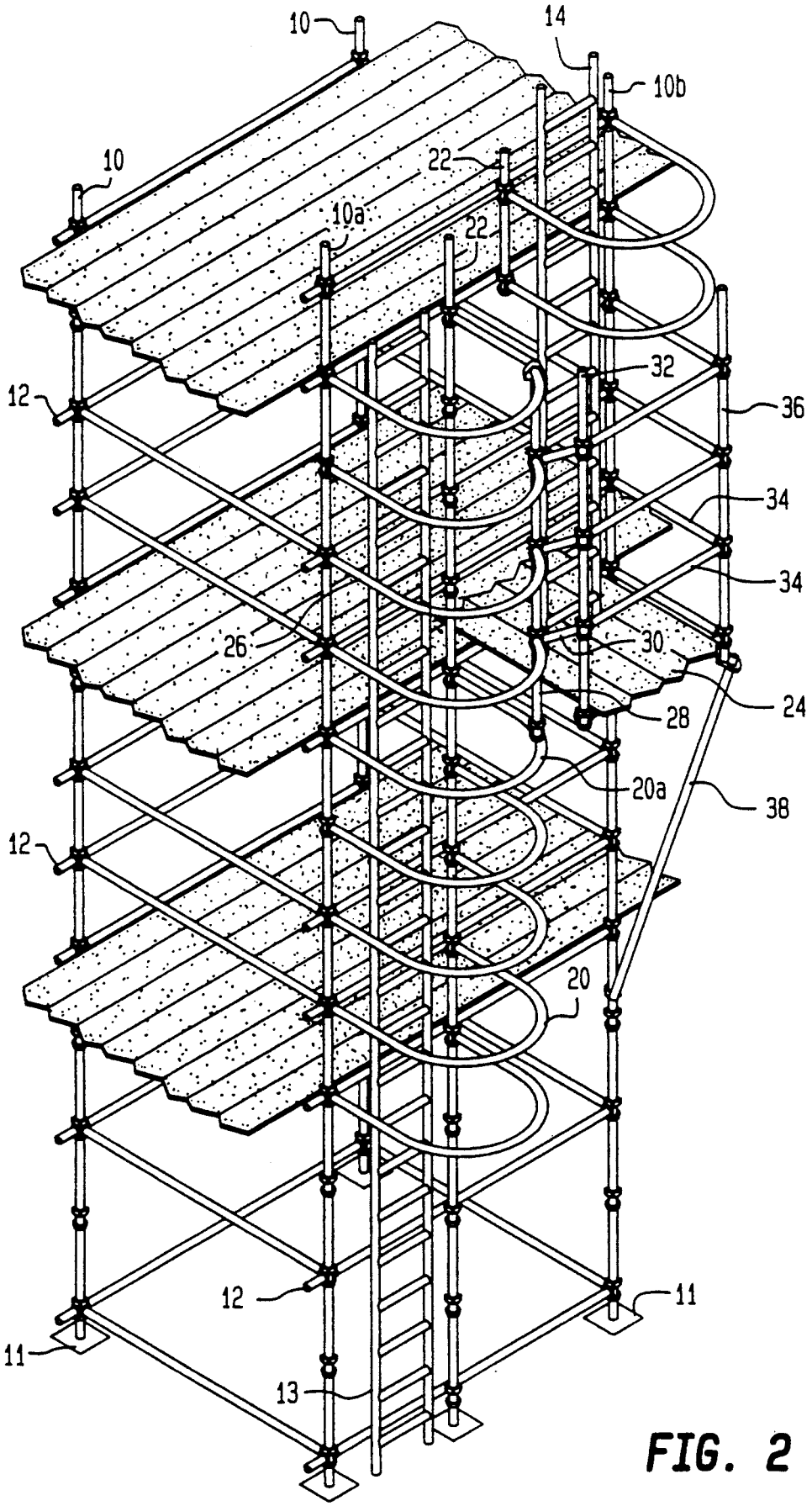
FIG. 2 is a perspective view showing a scaffolding structure having a ladder with a protective assembly of the present invention.

FIG. 2 hereof is a perspective view of a scaffolding structure which is also comprised of a plurality of upright members 10 and horizontal tubular members 12, all of which are not numbered in the figure. A ladder system is shown which is comprised of a lower ladder 13 and an upper ladder 14 in alternating vertical staggered series, and with the protective assembly of the present invention. The protective assembly is comprised of substantially U-shaped curved horizontal members 20 containing a short leg and a long leg. The long leg of each curved horizontal member is detachably connected to a retention means of weight-bearing upright member 10a and the short leg is detachably secured to retention means of non-weight bearing upright member 22. It will be understood that the protective assembly of the present invention can be designed such that the ladder need not be secured to the structure in the proximity of a weight-bearing upright. The ladder can be secured at a location where a non-weight bearing upright is needed in the proximity of each side of the ladder. In such a case, the curved horizontal members would be symmetrical around a longitudinal axis passing through the greatest point of curvature. That is, both legs of the U-shaped horizontal member will be substantially the same length. For economic reasons, it is preferred that the ladder be secured in the proximity of a weight-bearing upright so that one end of a curved horizontal member can be attached thereto. Thus, only one additional upright member need be used for each ladder, which upright member is secured to the scaffolding structure in the proximity of the other side of the ladder. Of course, the retention means for the non-weight bearing upright member must be the same as that of the weight-bearing upright members and in substantially the same vertically spaced locations.

As previously mentioned, the protective ladder assembly of the present invention can be practiced on any suitable scaffolding system employing a connector/retention system for assembly. The protective assembly of the present invention is most effectively practiced with a locking cup type of scaffolding system from a materials point of view. That is, with a locking cup system, the same curved horizontal member can serve as either a left handed piece or a right handed piece. That is, the non-weight-bearing upright member can be on either side of the ladder with the weight-bearing upright on the other. This feature can well be appreciated with reference to FIG. 2 hereof wherein it can be visualized that all of the curved horizontal members used for the protective assembly of the lower ladder can be reversed, or turned over, and used for the upper ladder as well. In wedge-type scaffolding systems, the curved horizontal member is either a left handed member or a right handed member and cannot serve as both because the wedge, which is an integral part of the horizontal member, can only be secured from the top. That is, if a curved horizontal member containing a pivotal wedge at each of its ends were to be reversed from its normal position, the wedges would have to be driven from the bottom upwards. This would ultimately result in the wedges working loose, followed by scaffolding failure.

Typical scaffolding systems contain upright members in lengths ranging from about 3 to 10 feet with retention means being vertically spaced at a distance from about 18" to 24" along their length. Horizontal members, or runners, generally vary in length up to about 8 feet. Most scaffolding structures must meet safety regulations and thus the uprights are usually not placed more than about 8 feet apart, typically not more than about 7 feet apart. The scaffolding members used to erect the scaffolding structures of the present invention are generally tubular in shape and are manufactured from any appropriate metal, such as a steel or light-metal profiled steel.

While a ladder may be attached to either an upright or horizontal member, it is preferred, for the practice of the present invention, that it be attached to horizontal members. If the ladder were attached to an upright member (that is in front of, and offset from an upright member), then two non-weight bearing upright members would have to be employed instead of only one. By securing the ladder to horizontal members in the proximity of a weight-bearing upright, only one non-weight bearing upright need be used. It is preferred to place the non-weight bearing upright member about 3 to 4 feet from a weight-bearing upright with a ladder in between. Another non-weight-bearing upright, containing the same retention means at the same vertical locations as the weight-bearing upright, is secured to the structure 3 or 4 feet from the next immediate weight-bearing upright. That is, there will be a weight-bearing upright, a ladder, a non-weight bearing upright 3 to 4 feet from the weight-bearing upright, another non-weight bearing upright 1 to 2 feet from the first non-weight bearing upright, another ladder positioned at a level on the structure substantially higher than the first ladder, then another weight-bearing upright 3 to 4 feet from the second non-weight bearing upright. Further, the ladders are typically secured by use of a bracket which offsets (typically from about 7 to 9 inches) them from the basic scaffolding structure so the members of the basic structure do not interfere with an operative climbing said ladders.

Because the non-weight bearing upright is secured to the outside of the scaffolding structure, and the weight-bearing upright is an integral part of the structure, the curved horizontal member will typically contain a short leg and a long leg. That is, it will be substantially U-shaped with one side, or leg, being longer than the other. The short leg, of course, is to compensate for the diameter of the non-weight-bearing upright with retention means. When the curved horizontal members of the present invention are secured at both ends as described, a protective cage assembly is formed around the ladder. That is, if an operative on the ladder loses his or her balance, he or she can reach out and grab the nearest curved horizontal member. The curved horizontal member is constructed so that all parts of it are in relative close proximity of an operative standing on the ladder at the level of the curved horizontal member. That is, the curved horizontal members are within easy reach of an operative on the ladder. Typically, the curved section of the curved horizontal member will extend no more than 4 feet, preferably no more than 3½ feet, more preferably no more than 3 feet from the ladder and most preferably no more than 30 inches away from the ladder.

Because it is unsafe to have a single ladder run the entire height of a relatively high scaffolding structure, two or more ladders are usually placed in alternating vertical staggered series. This is shown in both FIGS. 1 and 2 wherein lower ladder 13 extends from ground level to some predetermined distance, usually from about 20–30 feet. The precise height to which each ladder extends will typically be determined by the type of construction the scaffolding is to be used for, as well as various safety regulations which must be met. The next higher ladder 14 in the vertical staggered series is then secured to the scaffolding structure at some distance between the lower ladder and the next weight-bearing upright member and extended another 20–30 feet. If a third ladder is used, it is staggered from the second ladder so that it is over the first ladder. Platform 15, which extends out from the basic scaffolding structure, serves as a rest area and allows an operative to step from the upper section of the lower ladder onto the platform and have safe access to the next higher ladder. This platform will also serve to break the fall of an operative in case of a fall. Because the U-shaped curved horizontal members are designed to provide an enclosed cage around the ladder, second curved horizontal members 26, being substantially J-shaped, are provided. That is, the second curved horizontal member resembles a J-shape because it contains only one leg and a curved section. The absence of the other leg when compared with the U-shaped members allow unobstructed access to the platform from the lower ladder. The J-shaped curved horizontal members 26 can be supported by any appropriate means, preferably by use of a shorter length of upright 28, one end of which is secured to the upper-most U-shaped curved horizontal members 20*a* at platform level for any given ladder. The length of upright 28 is long enough to extend to the top of ladder 13 and provide retention means for receiving connector means of the curved end of J-shaped curved members 26. Protective railings can be erected around the platform by use of standard upright and horizontal members and the appropriate connector/retention systems. For example, short lengths of conventional horizontal members 30 can connect to upright member 28 and upright member 32. The protective cage around the platform can be completed by providing horizontal members 34 connected to weight-bearing upright member 10*b* and upright member 36. The platform can be supported by use of diagonal cross brace 38. It will be noted that at the top of said length of upright 28 there is provided another U-shaped curved horizontal member having one end attached to weight-bearing upright 10*a*, its other end connected to non-weight bearing upright 22, and an attachment to said length of upright 28 along its curvature.

Ladder 14 is also protected in accordance with the present invention. That is, substantially U-shaped horizontal members 20 are provided wherein one end is connected to non-weight bearing upright 22 and the other end is attached to weight-bearing upright 10*b*. Such curved horizontal members are provided up the length of second ladder 14 until another platform area is reached, whereupon substantially J-shaped curved members 26 and short length uprights 28 are again used as previously described to allow access to said platform from the top section of upper ladder 14.

Figure 3:
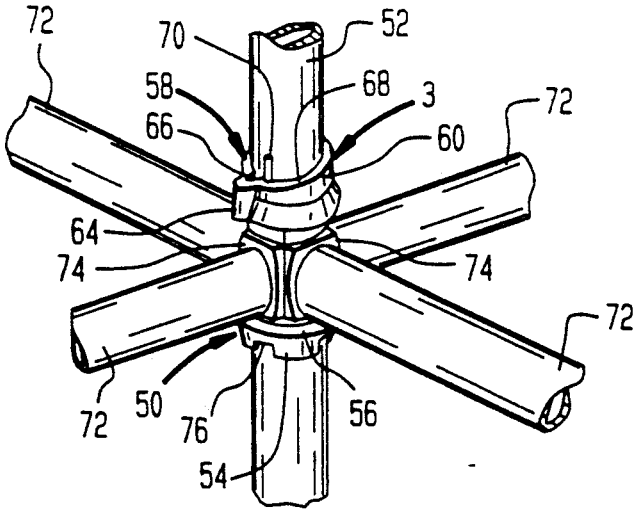
FIG. 3 shows a preferred connector/retention system for detachably securing the protective assembly of the present invention to a scaffolding structure.

FIG. 3 shows a preferred connector/retention system for use on the protective assembly of the present invention. The system shown is a so-called locking cup system which is an integral part of scaffolding manufactured by SGB Group Limited, Surry, United Kingdom and which is disclosed in detail in U.S. Pat. No. 3,992,118. In this figure, there is shown, at its lower end, a retaining element in the form of a bush or cup-like member 50 which is welded to an upright member 52 so as to define an annular channel around it, such channel being open at its upper end. The lower part 54 of the wall of the bush is inclined upwardly and outwardly from the upright member and terminates in a short upper part 56 of cylindrical form. The connection also comprises, at its upper end, a retaining element in the form of a clamping bush or cup-like member 58, which is slidably mounted on the upright member 52 and also defines a channel around it, the channel in this case, however, being open at its lower end, the wall of the clamping bush having a cylindrical upper part 60 which fits closely around the upright member and a downwardly and outwardly inclined lower part 62. At one side, the clamping bush 58 has a projection 64 in which there is formed, adjacent the upright member 52, a vertical slot 66. The top face 68 of the clamping bush 58 may be inclined upwardly from either side of the projection 64, as shown, or continuously for a full 360° from one side, thus forming a wedge-shaped surface.

The upright member 52 has on the side thereof an integral lug 70 which is of such size that it can pass through slot 66 in the projection 64 on the clamping bush. Thus, if the clamping bush is turned to bring the lug 70 into line with the slot 66, then the clamping bush can be moved up and down the upright member 52 past the lug. A horizontal member 72 is welded at each end into an apertured plate 74 provided with upwardly and downwardly directed tongues, the form of the tongues being defined as a quarter of a cylinder so that when the tongues on the end plates on the four horizontal members 72 have been inserted into the bush 50, they fit tightly together around the upright member. One or more of the horizontal members can be the curved horizontal member of the present invention. However, the end plates may be provided with protuberances which actually abut the upright member. This allows for dirt or rust which may be present, and also for any tolerance differences. The fixed bush 50 is preferably formed with one or more apertures 76 along its bottom edge to allow for the escape of water and dirt.

Figure 4:
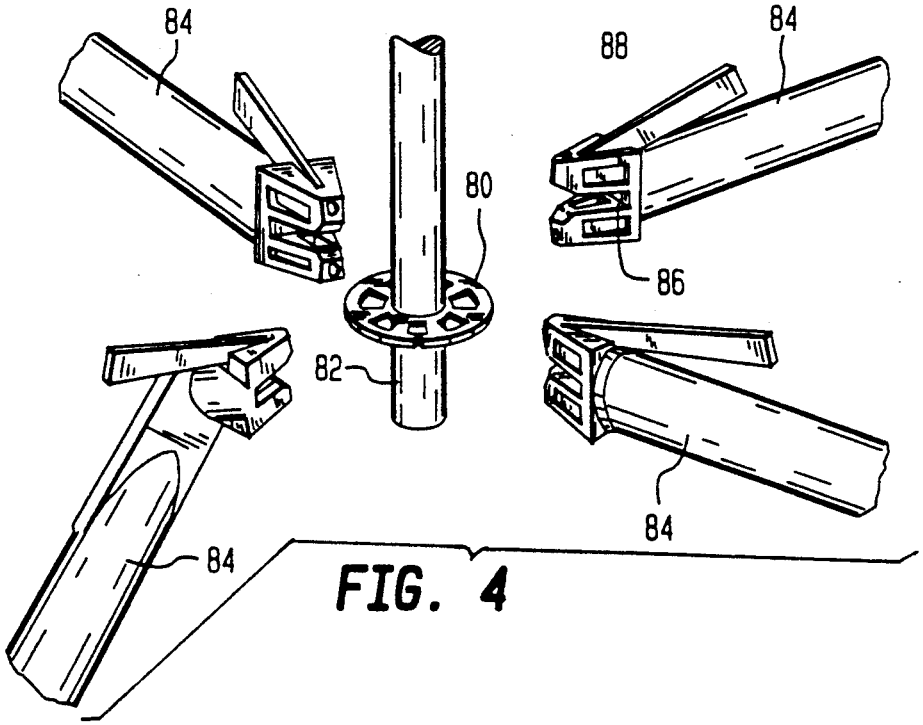
FIG. 4 shows another preferred connector/retention system for detachably securing the protective assembly of the present invention to a scaffolding structure.
Figure 5:
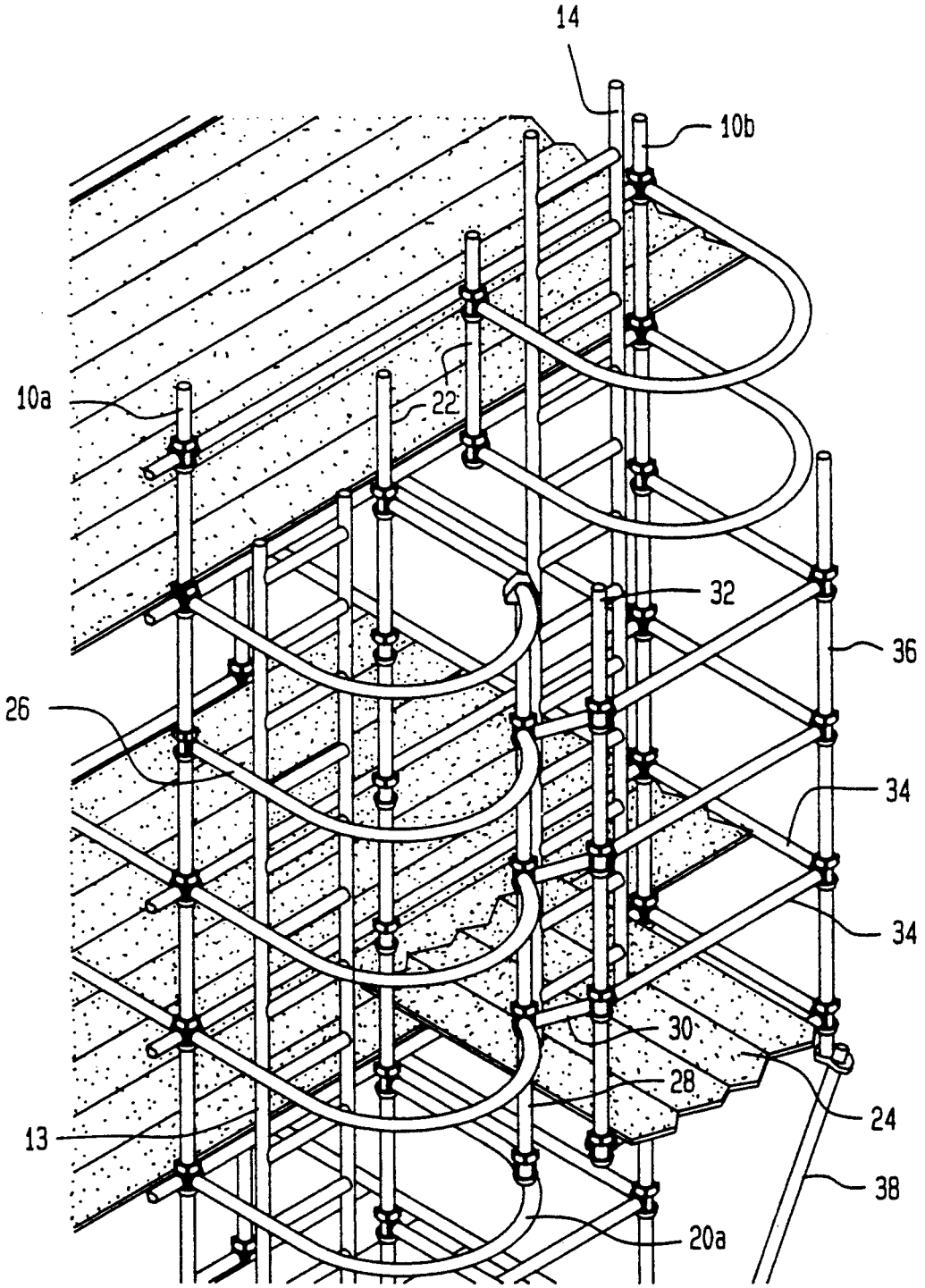
FIG. 5 shows a close-up view of a section of the scaffolding structure of FIG. 1 showing the top section of a lower ladder with unobstructed access to a platform at the bottom of a higher ladder. Each ladder is provided with the protective assembly of the present invention.

FIG. 4 hereof shows a typical wedge/disc scaffolding available from Anthes Equipment Limited of Mississauga, Canada and described in detail in U.S. Pat. No. 4,587,780 which in incorporated herein by reference. This shows disc 80 welded to upright 82. A plurality of horizontal members 84, the ends of which are provided with horizontally disposed slots 86, which slots are adapted to receive a portion of locking disc 80 containing a plurality of radially extending locking cutouts 81. A locking wedge 88 is provided which is capable of pivoting within slot 86. The narrow end of the wedge can also be provided with a stud (not shown) to prevent complete removal of the wedge from the horizontal member. When the slot of a horizontal member is positioned to receive a portion of said locking disc, the wedge is pivoted and pushed downward so that it is pushed through a locking cutout as far as it can go. This locks the connector means (wedge) of a horizontal member to a retaining means (disc) of an upright member.

Various changes and/or modifications, such as will present themselves to those familiar with the art may be made in the method and apparatus described herein without departing from the spirit of this invention whose scope is commensurate with the following claims.

What is claimed is:

1. A scaffolding structure of the type which uses a connector/retention system for detachably securing horizontal members to rigid upright members, which structure is comprised of:

(a) a plurality of rigid upright members containing retention means at vertically spaced locations for receiving connector means secured to the ends of horizontal members;

(b) a plurality of horizontal members, each containing two ends, with each end having a connector means secured thereto which are detachably connected to said retention means of said rigid upright members, thereby forming a basic free standing scaffolding structure having three or more sides, said plurality of rigid upright and horizontal members being an integral part of the scaffolding structure:

(c) a ladder which is secured to the outside of the basic scaffolding structure in a vertical position being substantially parallel to said rigid upright members, such that there is a rigid upright member in the proximity of each side of said ladder; and (d) curved horizontal members which are substantially U-shaped, wherein each end has secured thereto a connector means which is detachably connected to retention means of said rigid upright members starting at a predetermined distance from the bottom of the ladder to provide unobstructed access of an operative to said ladder, which upright members are in the proximity of each side of said ladder, thereby enclosing the ladder with said curved horizontal members at the level of each connection, wherein the dimensions of said curved horizontal members are such that all portions of said curved horizontal members are in the proximity of an operative on said ladder; wherein the connector/retention system is selected from the group consisting of the wedge-type, the double-ring type, the peg/socket type, the lever/dish type, and the locking cup type.

2. The structure of claim 1 wherein the connector/retention system is selected from the wedge/disc type and the locking cup type.

3. The structure of claim 2 wherein the connector/retention system is the locking cup type comprised of: (i) a retention means comprised of (a) a first retaining element in the form of a cup-like member which is secured to an upright member so as to form a channel around it, such channel being open at its upper end; and (b) a second retaining element in the form of clamping cup-like member, which is slidably mounted on the upright member and also defines a channel around it, which channel is open at its lower end; and (ii) a connector means which is comprised of an apertured plate secured to the ends of the horizontal members such that there is upwardly and downwardly directed tongues from the ends of said horizontal members.

4. The scaffolding structure of claim 1 wherein the upright member in the proximity of one side of said ladder is an integral part of the free standing basic scaffolding structure by having a plurality of its retaining means detachably connected to the connecting means of a plurality of horizontal means, and wherein the upright member to the other side of said ladder is not an integral part of the basic scaffolding structure, but is attached to the outside of said basic scaffolding structure by being secured to a plurality of horizontal members at some point between their ends.

5. The structure of claim 4 wherein the connector/retention system is of the wedge/disc type and is comprised of a retention means secured to said upright members at vertically spaced locations, which retention means are characterized as a disc having radially directed cutouts for receiving connecting wedges and wherein the connector means, at the ends of the horizontal members, are characterized as having a horizontally disposed slot for receiving a portion of the disc and a wedge which is pivotable within said slot and which is capable of partially passing through said cutouts.

6. A scaffolding structure of the type which uses a connector/retention system for detachably securing horizontal members to upright members, which structure is comprised of:

(a) a plurality of rigid upright members containing retention means at vertically spaced locations for receiving connector means secured to the ends of horizontal members;

(b) a plurality of horizontal members, each containing two ends, with each end having a connector means secured thereto which are detachably connected to retention means of said rigid upright members, thereby forming a basic free standing scaffolding structure having three or more sides, said plurality of rigid vertical and horizontal members being an integral part of the scaffolding structure:

(c) two or more ladders secured to the outside of the basic scaffolding structure between two rigid upright members of said basic scaffolding structure, said ladders being in alternating vertical staggered series such that the upper section of the lower ladder covers the same vertical distance as the lower section of the next higher ladder, and such that there is an outside side of each ladder and an inside side, the outside side being in the proximity of a rigid upright member which is an integral part of the basic scaffolding structure and the inside side being in the proximity of a rigid upright member which is secured to the outside of said basic scaffolding structure;

(d) curved horizontal members which are substantially U-shaped, wherein each end has secured thereto a connector means which is detachably connected to retention means of said rigid upright members starting at a predetermined distance from the bottom of each ladder thereby providing an operative with unobstructed access to said ladder, and ending at the level of a platform at the base of the next higher ladder, which rigid upright members are in the proximity of each side of said ladder, thereby enclosing the ladder with said curved horizontal members at the level of each connection, wherein the dimensions of said curved horizontal members are such that all portions of said curved horizontal members are in the proximity of an operative on said ladder; and (e) curved horizontal members which are substantially J-shaped starting at the level of the platform of the next higher ladder and continuing to the top of said next higher ladder, wherein each end of said J-shaped curved members has secured thereto a connector means which is detachably connected at its long end to the rigid upright member to the outside side of a ladder and the other end connected to a non-weight-bearing member to the inside of a ladder, thereby providing unobstructed access from a lower ladder to the platform of the next higher ladder.

7. The scaffolding structure of claim 6 wherein the upright member in the proximity of one side of said ladder is an integral part of the free standing basic scaffolding structure by having a plurality of its retaining means detachably connected to the connecting means of a plurality of horizontal means, and wherein the upright member to the other side of said ladder is not an integral part of the basic scaffolding structure, but is attached to the outside of said basic scaffolding structure by being secured by clamping means to a plurality of horizontal members at some point other than at their ends.

8. The structure of claim 7 wherein the connector/retention system is selected from the group consisting of the wedge-type, the double-ring type, the peg/socket type, the lever/dish type, and the locking cup type.

9. The structure of claim 8 wherein the connector/retention system is selected from the wedge/disc type and the locking cup type.

10. The structure of claim 9 wherein the connector/retention system is the locking cup type comprised of: (i) a retention means comprised of (a) a first retaining element in the form of a cup-like member which is secured to an upright member so as to form a channel around it, such channel being open at its upper end; and (b) a second retaining element in the form of clamping cup-like member, which is slidably mounted on the upright member and also defines a channel around it, which channel is open at its lower end; and (ii) a connector means which is comprised of an apertured plate secured to the ends of the horizontal members such that there is upwardly and downwardly directed tongues from the ends of said horizontal members.

11. The structure of claim 7 wherein the connector/retention system is of the wedge/disc type and is comprised of a retention means secured to said upright members at vertically spaced locations, which retention means are characterized as a disc having radially directed cutouts for receiving connecting wedges and wherein the connector means, at the ends of the horizontal members, are characterized as having a horizontally disposed slot for receiving a portion of the disc and a wedge which is pivotable within said slot and which is capable of partially passing through said cutouts.

* * * * *